United States Patent [19]

Spinner

[11] Patent Number: 4,717,799

[45] Date of Patent: Jan. 5, 1988

[54] SWITCH DRIVE FOR A ROTARY SWITCH

[76] Inventor: Georg Spinner, Am Eichberg 12, 8152 Feldkirchen-Westerham, Fed. Rep. of Germany

[21] Appl. No.: 769,480

[22] Filed: Aug. 26, 1985

[30] Foreign Application Priority Data

Aug. 24, 1984 [DE] Fed. Rep. of Germany ..... 3431252

[51] Int. Cl.[4] ..... H01H 3/42

[52] U.S. Cl. ..... 200/153 P; 74/394

[58] Field of Search ..... 200/153 P, 336, 153 PA; 74/98, 52, 394, 788, 785, 801

[56] References Cited

U.S. PATENT DOCUMENTS 4,088,035 5/1978 Boden ..... 74/52
4,424,781 1/1984 Speer et al. ..... 74/98

FOREIGN PATENT DOCUMENTS 1189619 3/1965 Fed. Rep. of Germany .
2211329 5/1974 Fed. Rep. of Germany .
2724448 10/1978 Fed. Rep. of Germany .

*Primary Examiner*—Henry J. Recla
*Assistant Examiner*—Renee S. Luebke
*Attorney, Agent, or Firm*—Henry M. Feiereisen

[57] ABSTRACT

A switch drive for a rotary switch includes a toothed gearing which is driven by an electromotor at its input and is provided with a switch drive shaft at its output. For obtaining a high switching speed upon soft initiation and especially soft termination of the switching process, the switch drive shaft 14 is connected in a rotation-fixed manner with a switch arm 12 in which a engaging member 10 engages which is supported eccentrically by a gear 6. The gear 6 is driven by the electromotor via a pinion 5. The engaging member 10 is arranged eccentrically to the switch drive shaft 14 such that the engaging member 10 describes with respect to the circle as described by the switch arm 12 either a hypocycloid or an epicycloid.

5 Claims, 11 Drawing Figures

Figure 1:
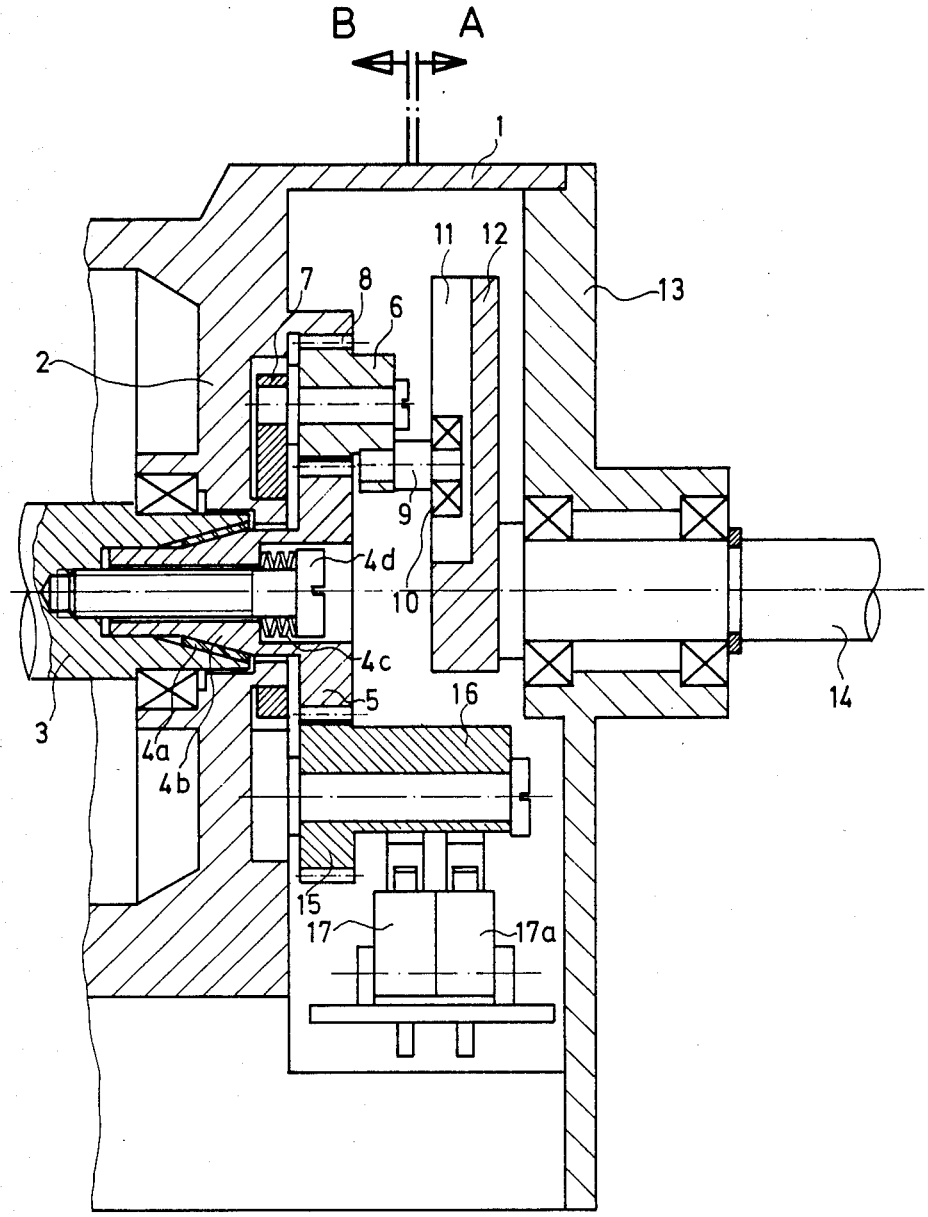

FIG. 6
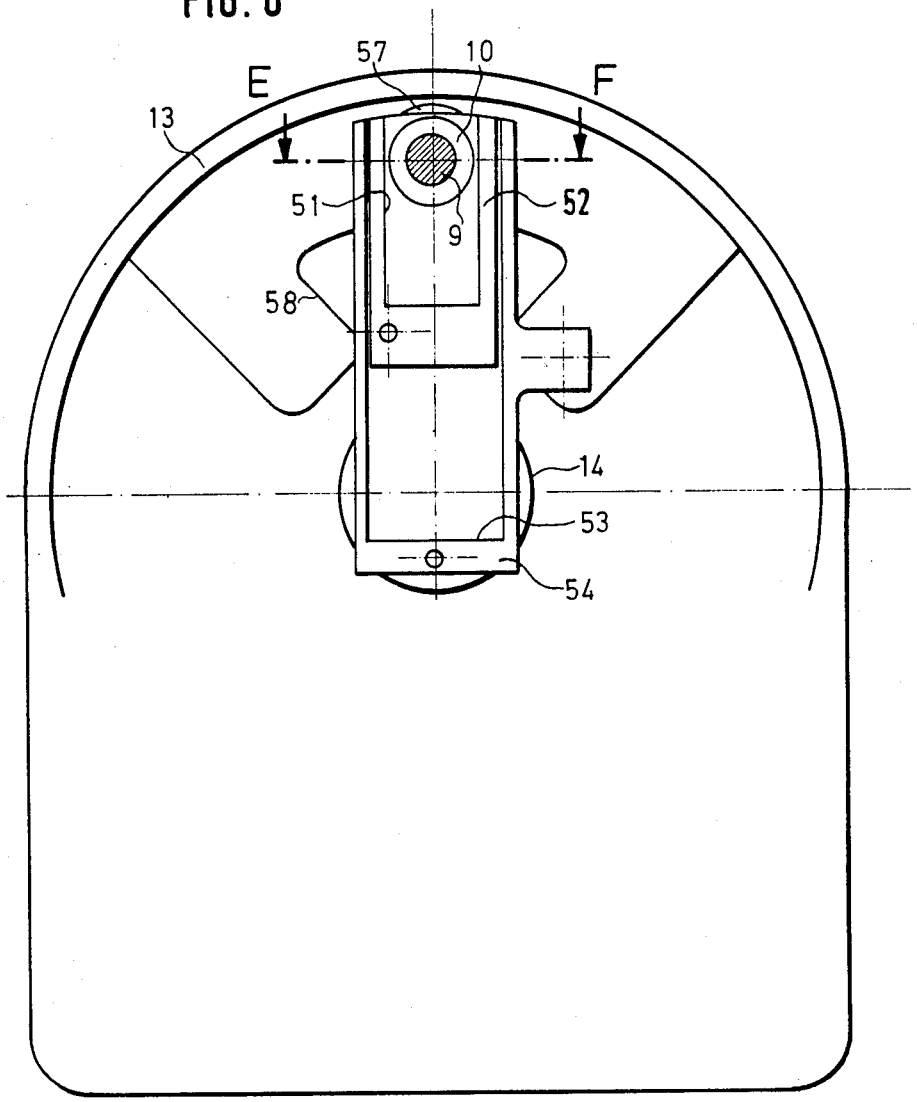
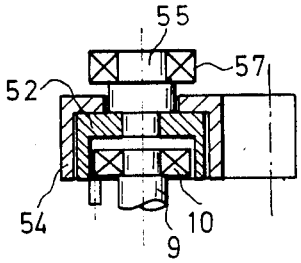
FIG. 7

SWITCH DRIVE FOR A ROTARY SWITCH

FIELD OF THE INVENTION

The invention refers to a switch drive for a rotary switch preferably with an operating angle of 90° including a toothed gearing which is driven by an electromotor at its input and provided with a switch drive shaft at its output.

BACKGROUND OF THE INVENTION

Such switch drives are required for example for remote control of coaxial switches. Obviously, it is desired to keep the switching time as short as possible. More important, however, is the fact that the switch rotor precisely reaches its end position in each switching position. In view of the considerably moved masses of the switch rotor as well as of its drive in particular when power switches are concerned, the problem has been encountered to smoothly accelerate and especially to smoothly decelerate the switch rotor upon reaching its end position despite considerable switching speed in order to prevent mechanical damages of the rotary switch and/or its drive as well as bouncing actions. This problem could be solved with a switch drive as mentioned in the introductory part only when the toothed gearing has a high step-down ratio which necessarily results in a low switching speed.

OBJECT OF THE INVENTION

The invention is based on the object to create a switch drive of the mentioned kind which combines a high switching speed with a smooth initiation and especially smooth termination of the switching action.

This object is realized according to the invention by providing an eccentric engaging member supported by a toothed gearing and a switch arm which is fixedly connected to the switch drive shaft and cooperates with the engaging member in such a manner that the engaging member describes a hypocycloid thereby causing a movement of the switch arm along a circular arc between two defined end positions, and moves radially with respect to the switch drive shaft so as to prevent a further rotation of the latter.

Thus, the switch drive shaft which is accurately rotatable about an operating angle of 90° is initially smoothly accelerated when moving from one end position and smoothly decelerated when reaching the other end position. The hypocycloidal motion of the engaging member leads to a very accurate positioning of the switch arm in its both end positions so that the provision of additional stops becomes unnecessary. Moreover, the step-down gearing in this type of construction is provided with a self-locking mechanism.

Preferably, the toothed gearing includes a pinion connected to the motor-driven shaft and meshes with a first gear which eccentrically supports the engaging member and runs along an internal toothing of the casing.

According to a further feature of the invention, the pinion cooperates with a second gear which actuates at least one microswitch to allow automatic preparation of the reversal of the rotational direction of the electromotor is required for the subsequent switching position.

Figure 2:
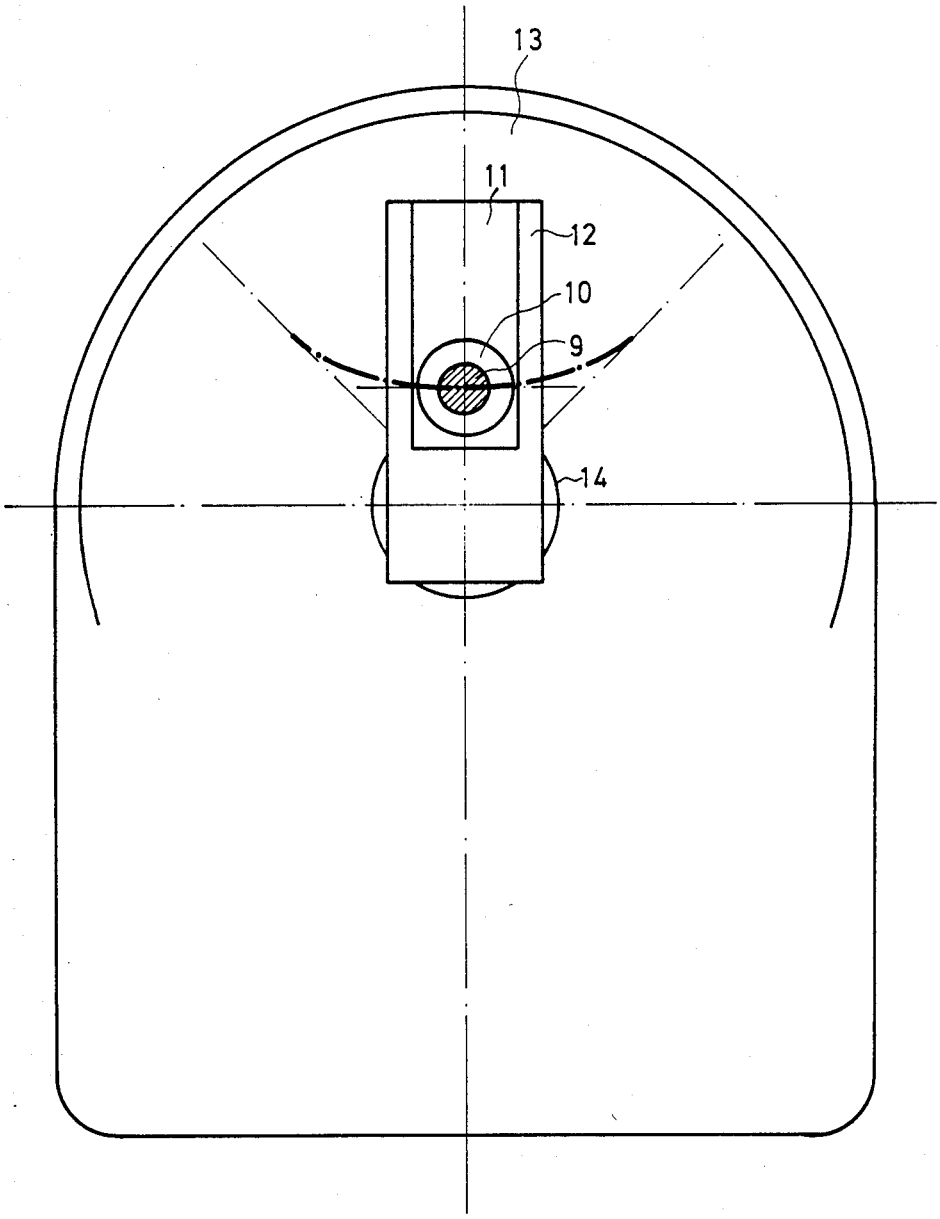
Figure 3:
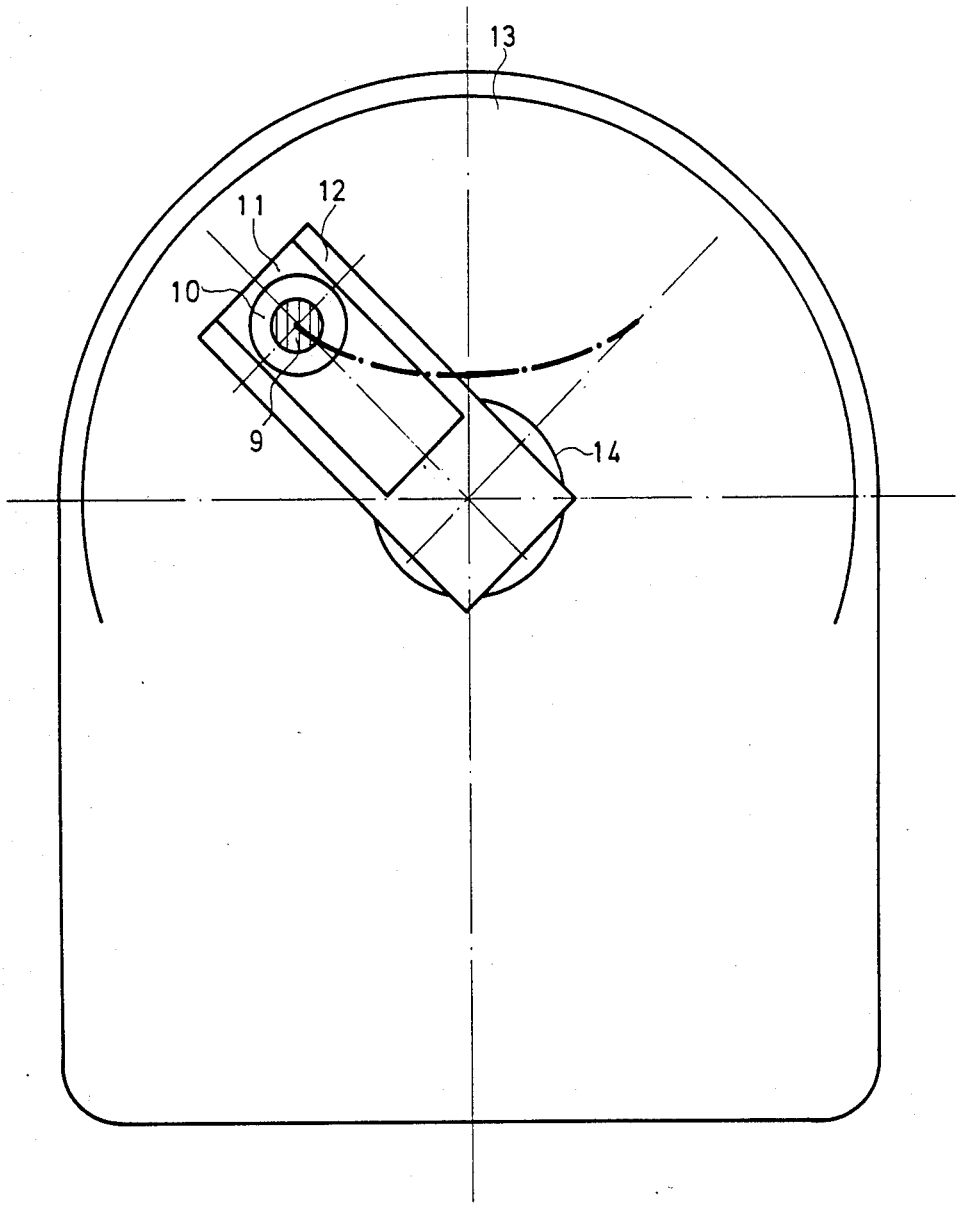
Figure 4:
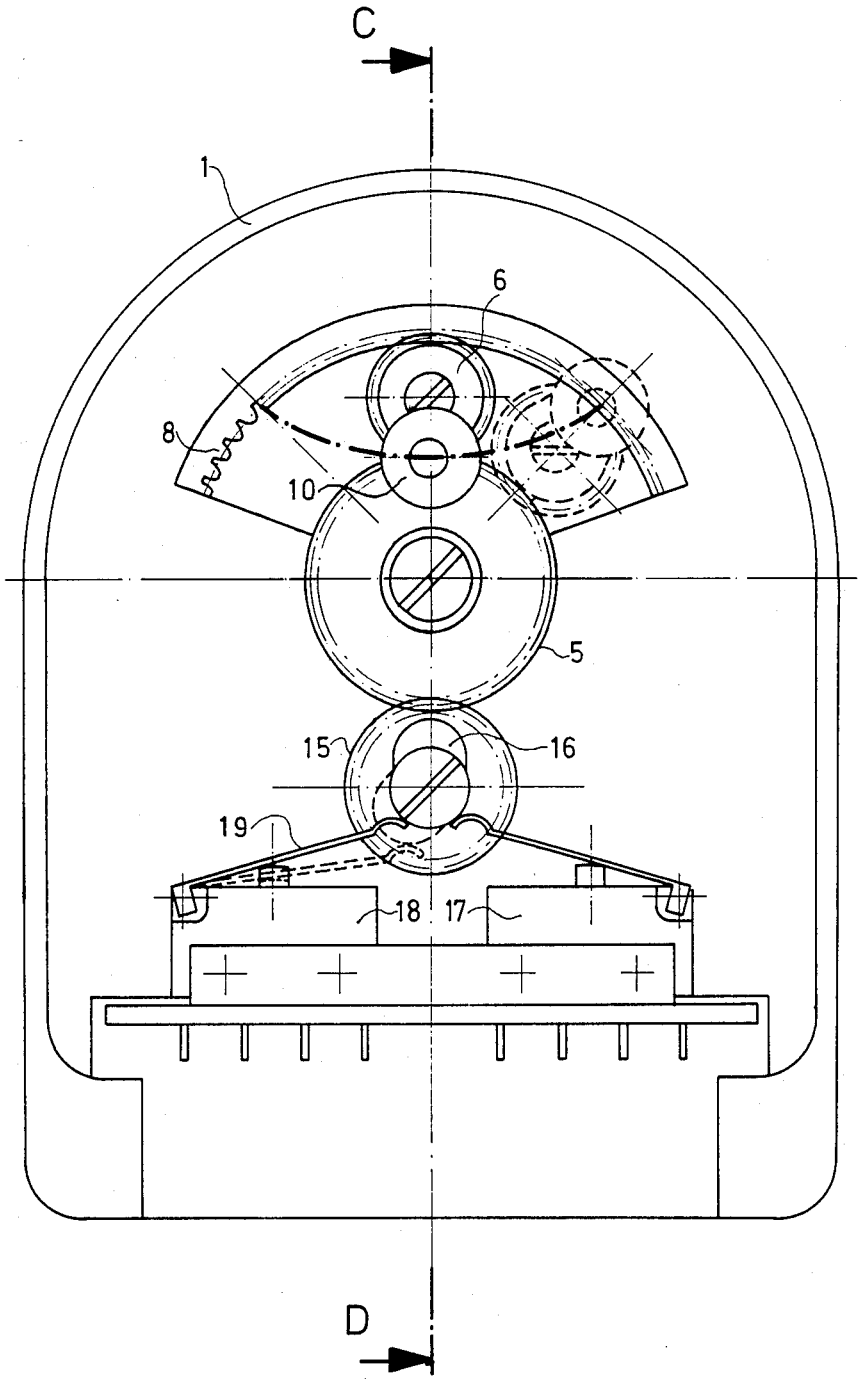
Figure 5:
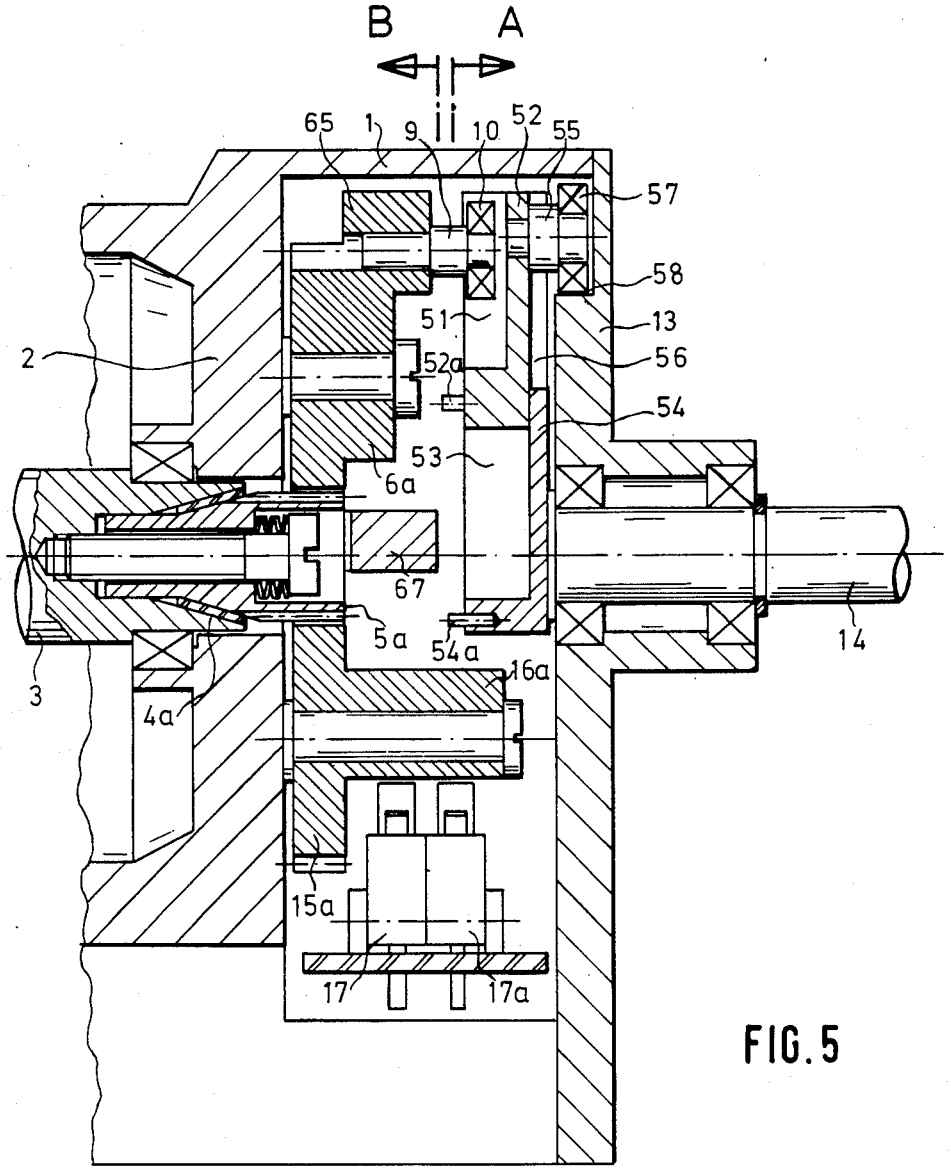
Figure 8:
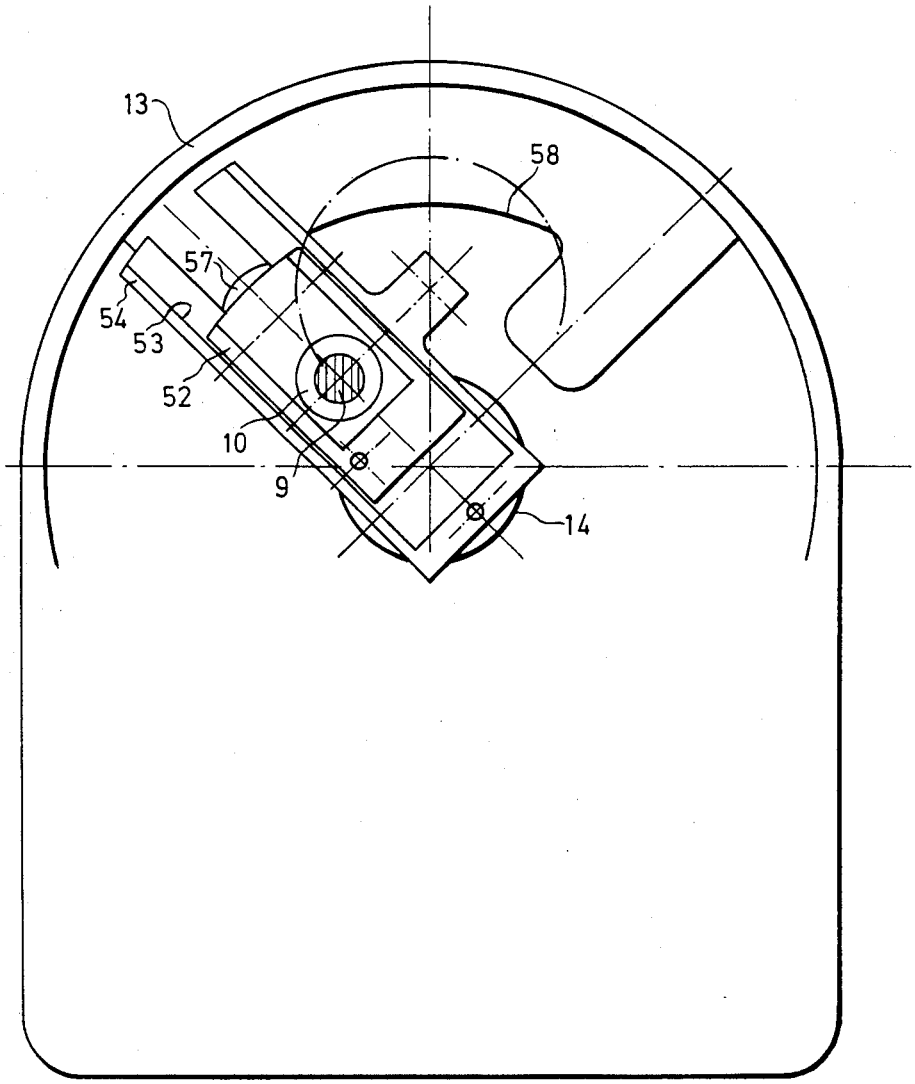
Figure 9:
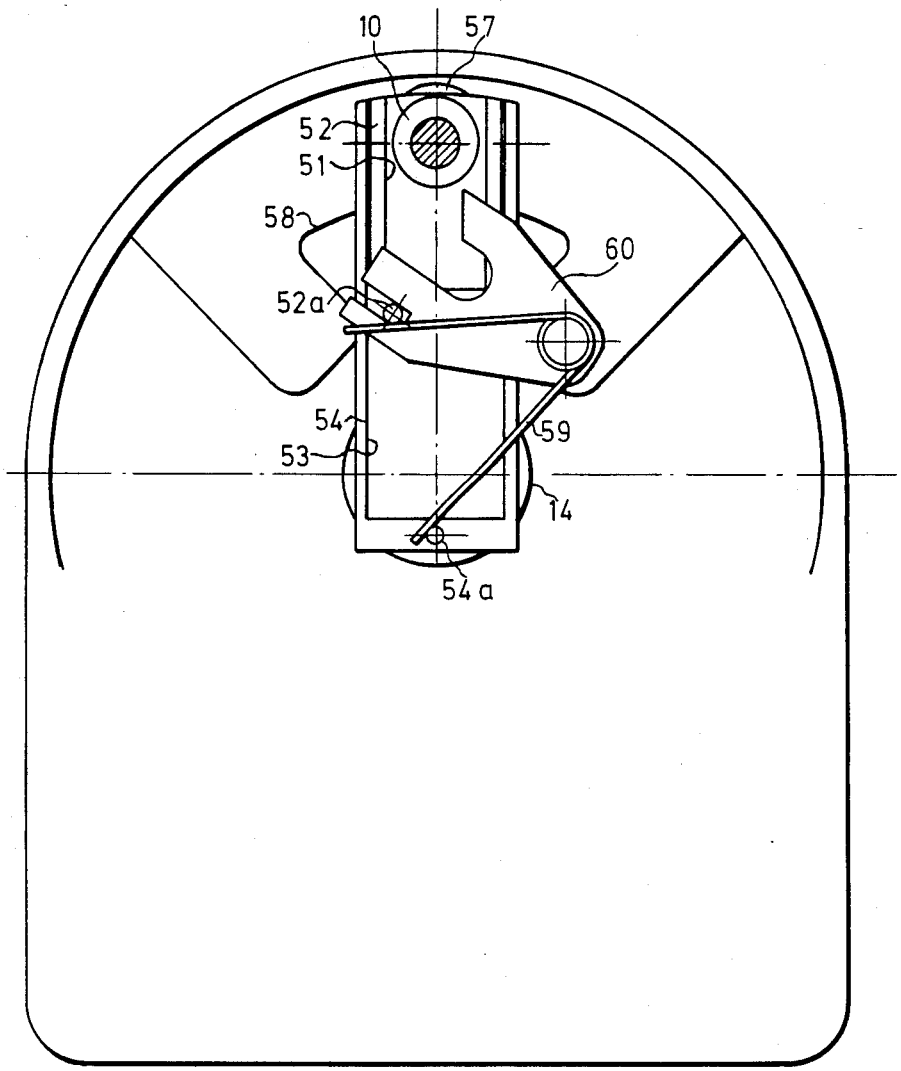
Figure 10:
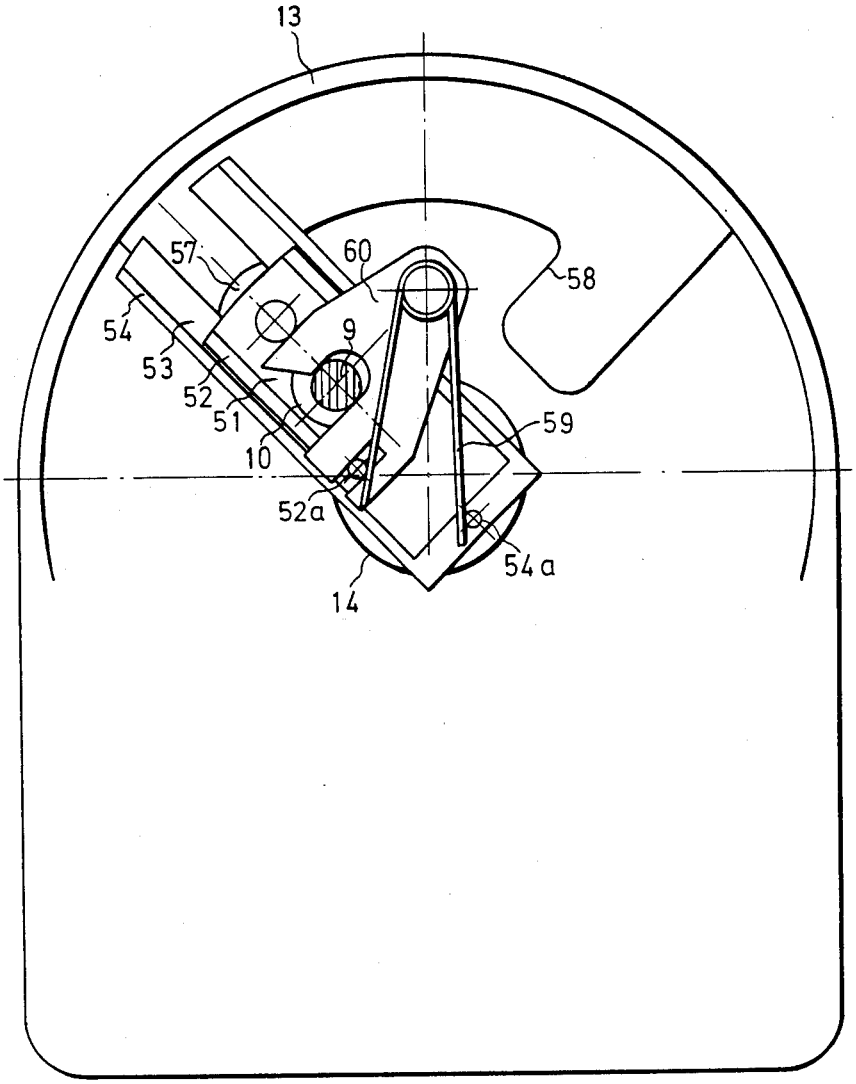
Figure 11:
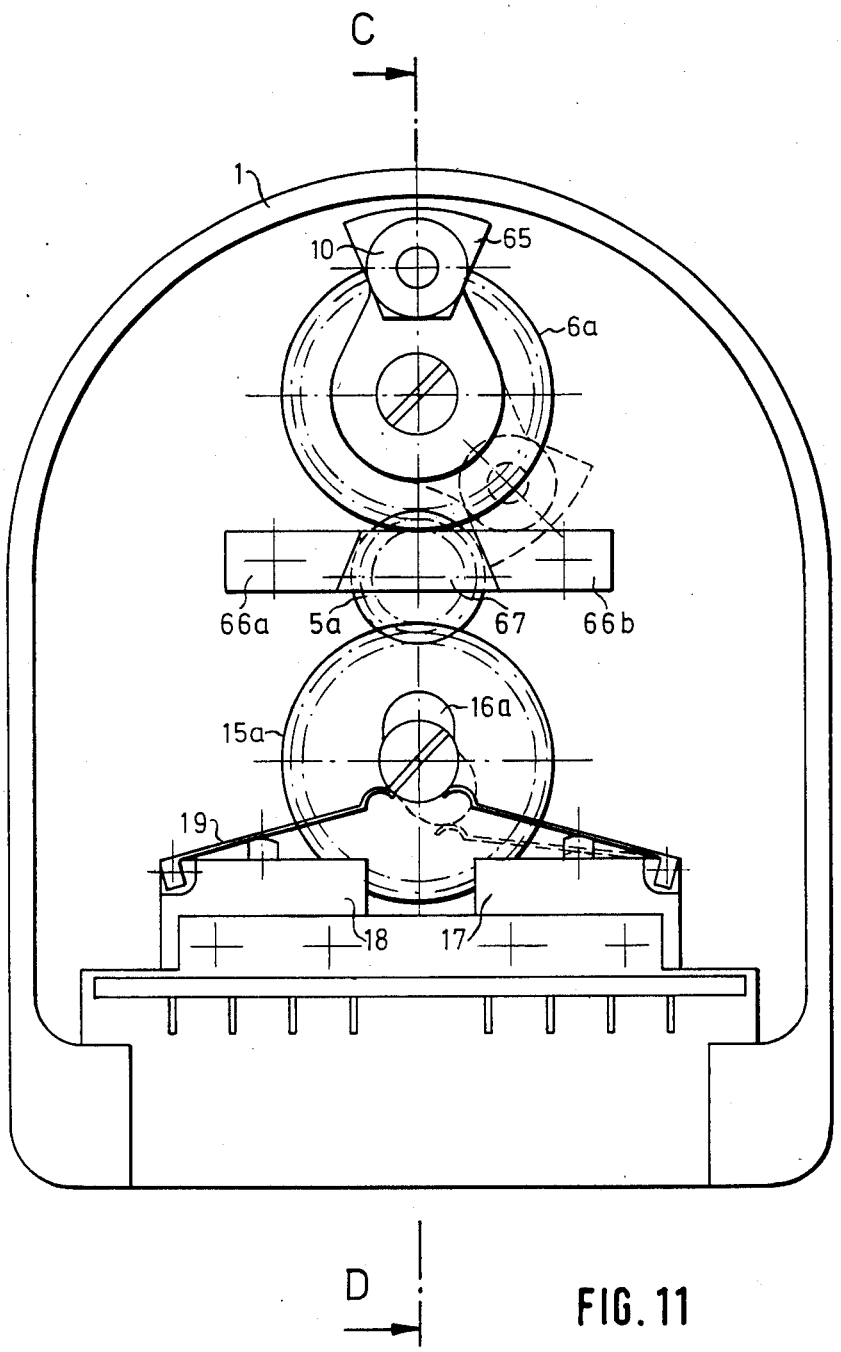

The drawing shows a schematic simplified illustration of the switch drive according to the invention by means of two exemplified embodiments. It shows:

FIG. 1 a longitudinal section of a first embodiment of the switch drive,

FIG. 2 a view according to arrow A in FIG. 1 with the switch arm in a central position, FIG. 3 the same view as FIG. 2 with the switch arm in one of its two end positions, FIG. 4 a view according to the arrow B in FIG. 1, FIG. 5 a sectional view of the second embodiment, FIG. 6 a view according to the arrow A in FIG. 5 with the switch arm in a central position, FIG. 7 a sectional view taken along the line E–F in FIG. 6, FIG. 8 a view according to the arrow A in FIG. 5 with the switch arm in one of its two end positions, FIG. 9 a view corresponding to FIG. 6 with an additional, spring-loaded rocking lever, FIG. 10 a view corresponding to FIG. 8 with an additional spring-loaded rocking lever in the end position and FIG. 11 a view according to arrow B in FIG. 5.

SPECIFIC DESCRIPTION

The switch drive according to the FIGS. 1 to 4 includes an essentially cylindrical casing 1 whose end wall 2 supports a shaft 3 driven by a not shown electromotor and driving a pinion 5 via a spring-loaded cone slipping clutch 4*a* to 4*d*. The pinion 5 acts as a sun wheel and meshes with a planet wheel forming gear 6 which is supported in a pinion cage 7 and rolls along an internal toothing 8 of the casing 1. The gear 6 supports eccentrically a bearing bolt 9 for engaging roller 10. The engaging roller 10 is arranged in a groove 11 of a switch arm 12 which is connected in a rotation-fixed manner to a switch drive shaft 14 supported in the casing lid 13.

The pinion 5 meshes further with a second gear 15 which is integral with a control cam 16 for actuating microswitches 17 as for example 17, 17*a* in FIG. 1.

The diameter and the number of teeth of the pinion 5, of the gear 6 and of the internal toothing 8 as well as the eccentricity of the engaging roller 10 are adjusted to each other such that the engaging roller describes with respect to the circular arc as described by the switch arm 12 the hypocycloid as shown in dash dotted line in FIGS. 2 to 4 during rotation of the shaft 3. In case of common rotary switches with an operating angle of 90°, the end points of the hypocycloid are arranged on two radii perpendicular to each other through the axis of the switch shaft.

As shown by a comparison of FIGS. 2 and 3, the hypocycloidal motion of the engaging roller 10 results in that the angular velocity imparted to the switch arm 12 during switching of one end position into another end position slowly increases from zero, reaches its maximum over a relatively wide angle area symmetrical to the central position and then drops slowly again to zero when the new end position is obtained. This is attributed to the fact that the engaging roller 10 moves in the groove 11 of the switch arm 12 initially only radially in direction to the axis of the switch drive shaft and then gradually changes into a tangential motion path until reaching the central position or median line. This results in a smooth acceleration at the beginning of the switching operation, a high switching speed between the end positions and a smooth braking at the end of the switching operation. Because of the radially directed displacement of the engaging roller 10 at the beginning and end of the switching operation, the position of the gear 6 as obtained in the end positions and thus of the driving shaft 3 is uncritical. This is even more true when the hypocycloidal motion of the engaging roller 10 is dimensioned such that at the reversing points no peaks but loops are obtained. Since the end position respectively reached by the engaging roller 10 is uncritical with respect to the end position of the switch arm 12, no end stops are required. The radial displacement of the engaging member 10 is, however, limited by the slip clutch 4a to 4b which disengages the engaging member 10 from the shaft 3 upon occurrence of excessive torque. In addition, as will be described furtherbelow, the radial displacement of the engaging member 10 is also stopped when the control cam 16 actuates one of the microswitches 17 to reverse the motor-driven shaft 3. Moreover, the radial displacement of the engaging roller 10 with respect to the axis of the switch drive shaft 14 which displacement in the end positions depends more or less on the dimension of the cycloidal path causes a self-locking mechanism when viewed from the switch drive shaft 14. Thus, the driven rotary switch does not require any additional arrests or other safety devices in its respective switch position.

The view B as illustrated in FIG. 4 shows again the path of motion of the engaging roller 10 from the drawn central position into one end position as drawn in broken lines, and in addition it is shown in broken lines the pertaining end position of the switch cam 16 in which the latter actuates the switch lever 19 of the microswitch 18 to reverse the electromotor.

FIGS. 5 to 11 illustrate a second embodiment of the switch drive. According to FIG. 5, the pinion 5a driven by the shaft 3 via a friction clutch meshes with a gear 6a which in contrast to the embodiment of FIGS. 1 to 4 is stationarily supported and rotates. The gear 6a eccentrically supports the bearing bolt 9 for the engaging roller 10 which extends in a groove 51 of a slide 52. The slide 52 is guided in a groove 53 of the switch arm 54 which is connected in a rotation-fixed manner with the switch drive shaft 14. Moreover, the slide 52 carries a bearing bolt 55 which projects through a slot 56 into the switch arm 54 and supports an index roller 57 running in a guideway 58 which is milled in the casing lid 13.

The guidance of the index roller 10 in the groove 51 of the slide 52 as well as the guidance of the slide 52 in the groove 53 and the course of the guideway 58 are illustrated in more detail in FIGS. 6 and 7.

The diameter and the number of teeth of the pinion 5a and of gear 6a as well as the eccentricity of the engaging roller 10 are selected in such a manner than this engaging roller 10 describes during rotation of the shaft 3 an epicycloid as shown in FIG. 8 whose end points for common rotary switches having a operating angle of 90° are arranged on radii perpendicular to each other through the axis of the switch drive shaft. In this case, the gear 6a rotates by about 270°.

Both end positions of the switch arm 54 are defined by the index roller 57 and the guideway 58. Without this index roller and its guideway, all engaging parts must be finished with very narrow tolerances as the end points of the epicycloid are arranged relatively close to each other and in the paraxial area. The described embodiment on the other hand requires a narrow tolerating only for the guideway 58 and the slot 56 in the switch arm 54 with respect to the bearing bolt 55 for the index roller 57.

Taking for example the end position as illustrated in FIG. 8, in order to disengage the index roller 57 at the beginning of a switching step from the index defined by the guideway 58, the slide 52 is loaded radially outwardly by a prestressed spring which for reasons of clarity has, however, not been illustrated in FIGS. 5 to 8. According to the FIGS. 9 and 10, this spring is designed as leg spring 59 which is supported on the one hand by a stop pin 52a of the slide 52 and, on the other hand, by a stop pin 54a of the switch arm 54.

FIGS. 9 and 10 illustrate in addition that on the switch arm 54, a rocking lever 60 is swingingly supported which for reasons of clarity has also been omitted in FIGS. 5 to 8 and which is in engagement via a slot with the stop pin 52a of the slide. A comparison of FIGS. 9 and 10 reveals that the rocking lever 60 is arranged and designed in such a manner that the bearing bolt 9 for the engaging roller 10 engages in a guideway of the rocking lever 60 shortly before reaching each of both end positions of the switch arm 54 and swings during the remaining angle of rotation the rocking lever 60 into the position as shown in FIG. 10 whereby the slide 52 is carried along by the rocking lever 60 via the stop pin 52 and thus pressed radially inwardly against the force of the leg spring 59 so that the index roller 57 engages the index as formed by the guideway 58. Consequently, the switch arm 54 is locked and positioned accurately in the end position. The purpose of the rocking lever is to gear the relatively short path as covered by the engaging roller 10 in direction radial to the axis of the switch drive shaft and thus to the rotational axis of the switch arm into a relative larger displacement of the slide 52 in order to allow a sufficiently deep penetration of the index roller 57 into the index formed by the guideway 58 in both end positions. Therefore, the rocking lever 60 could be omitted when the pinion 5a and the gear 6a are provided with respectively larger diameters and the drawback of a correspondingly bigger casing of the switch drive is accepted.

FIG. 11 shows the engaging roller in the central position as well as in broken lines the engaging roller in its one end position and both pertaining positions of the switch cam 16a of the further gear 15a which meshes with the pinion 5a wherein these latter parts operate in the same manner as the corresponding parts in the embodiment according to FIGS. 1 and 4.

In contrast to the embodiment according to FIGS. 1 to 4, in this embodiment at the gear 6a a stop 65 is provided which in each of both end positions of the gear 6a cooperates with a stationary casing stop 66a and 66b. In order to prevent a rebound, the three stops are of low-retentivity, and a permanent magnet 67 (compare also FIG. 5) is arranged between the stops 66a and 66b.

Otherwise, the movement of the engaging roller 10 in this embodiment is analogous to the movement as described in connection with FIGS. 1 to 4 so that the same stated advantages are achieved.

What is new and desired to be protected by Letter Patent is set forth in the appended claims:

1. A switch drive for a rotary switch, comprising:

a toothed gearing;

driving means including a shaft for driving said toothed gearing;

a switch drive shaft extending coaxially to said shaft; and transferring means for transmitting movement of said toothed gearing onto said switch drive shaft and including an eccentric engaging member supported by said toothed gearing and a switch arm fixedly connected to said switch drive shaft and cooperating with said engaging member so as to be movable between two defined end positions along a circular arc and rotating said switch drive shaft about an operating angle of about 90° such that said switch drive shaft is initially accelerated in a smooth manner from one of said end positions and smoothly decelerated when reaching the other one of said end positions, wherein said engaging member describes a hypocycloid thereby causing movement of said switch arm along said circular arc, and moves radially with respect to said switch drive shaft when the latter reaches said end positions so as to prevent a further rotation of said switch drive shaft.

2. A switch drive as defined in claim 1 wherein said switch arm is provided with an elongated groove, said engaging member projecting into said groove to move said switch arm between said end positions.

3. A switch drive as defined in claim 1 wherein said toothed gearing includes a pinion connected to said driving means and a first gear meshing with said pinion, said engaging member being arranged eccentrically on said first gear, and further comprising a stationary internal toothing extending coaxially to said switch drive shaft, said first gear meshing with said internal toothing so that said engaging member describes said hypocycloid thereby causing movement of said switch arm along said circular arc as described by said switch arm.

4. A switch drive as defined in claim 3 wherein said driving means includes an electromotor connected to said pinion via said shaft, and a slipping clutch interposed between said shaft and said pinion.

5. A switch drive as defined in claim 3 wherein said driving means includes a motor-driven shaft cooperating with said pinion, and further comprising actuating means for reversing said motor-driven shaft for allowing rotation of said switch arm between said end positions, said actuating means including a second gear meshing with said pinion, a switch cam connected to said second gear and at least one microswitch actuated by said switch cam upon reaching of said end positions by said switch arm.

* * * * *